US008095055B2

(12) United States Patent
Suzuki

(10) Patent No.: US 8,095,055 B2
(45) Date of Patent: Jan. 10, 2012

(54) ELECTROCONDUCTIVE ENDLESS BELT HAVING FLAME RETARDING MATERIAL

(75) Inventor: Takahiro Suzuki, Kodaira (JP)

(73) Assignee: Bridgestone Corporation, Tokyo (JP)

( * ) Notice: Subject to any disclaimer, the term of this patent is extended or adjusted under 35 U.S.C. 154(b) by 227 days.

(21) Appl. No.: 12/211,148

(22) Filed: Sep. 16, 2008

(65) Prior Publication Data

US 2009/0074480 A1 Mar. 19, 2009

(30) Foreign Application Priority Data

Sep. 18, 2007 (JP) ..... 2007-241295

(51) Int. Cl.
*G03G 15/20* (2006.01)

(52) U.S. Cl. ..... 399/308; 399/329

(58) Field of Classification Search ..... 399/308, 399/329; 252/601
See application file for complete search history.

(56) References Cited

U.S. PATENT DOCUMENTS

| | | | | |
|---|---|---|---|---|
| 5,304,628 | A * | 4/1994 | Kinoshita et al. | 528/370 |
| 6,627,690 | B1 * | 9/2003 | Hironaka | 524/412 |
| 7,142,800 | B2 * | 11/2006 | Natori et al. | 399/302 |
| 7,235,597 | B2 * | 6/2007 | Lee et al. | 524/120 |
| 2002/0111409 | A1 * | 8/2002 | Talibuddin | 524/417 |
| 2005/0118361 | A1 * | 6/2005 | Natori et al. | 428/32.69 |
| 2005/0271879 | A1 * | 12/2005 | Miura et al. | 428/412 |
| 2006/0131720 | A1 * | 6/2006 | Li et al. | 257/687 |
| 2007/0049674 | A1 * | 3/2007 | Kim et al. | 524/409 |
| 2007/0062635 | A1 * | 3/2007 | Tanaka et al. | 156/244.13 |
| 2007/0116958 | A1 * | 5/2007 | Suzuki et al. | 428/411.1 |

FOREIGN PATENT DOCUMENTS

| | | | |
|---|---|---|---|
| JP | 05-213504 | A | 8/1993 |
| JP | 06-093175 | A | 4/1994 |
| JP | 9-227717 | A | 9/1997 |
| JP | 10-120924 | A | 5/1998 |
| JP | 10-237278 | A | 9/1998 |
| JP | 2000-327922 | A | 11/2000 |
| JP | 2005-060658 | A | 3/2005 |

* cited by examiner

*Primary Examiner* — David Gray
*Assistant Examiner* — G. M. Hyder
(74) *Attorney, Agent, or Firm* — Sughrue Mion, PLLC

(57) ABSTRACT

An electroconductive endless belt for use as an intermediate transfer member that is disposed between an image-forming unit and a recording medium, is circularly driven by a drive unit, and temporarily holds a toner image transferred from the image-forming unit and subsequently transfers the toner image onto the recording medium, wherein the electroconductive endless belt has a multilayer structure including at least a surface layer disposed on a base layer, and the base layer is mainly composed of a polyester resin and/or a polyester elastomer and contains a conductive agent, a brominated epoxy resin, and an antimony compound, the polyester elastomer having a melting point of at least 210° C.

14 Claims, 2 Drawing Sheets

ELECTROCONDUCTIVE ENDLESS BELT HAVING FLAME RETARDING MATERIAL

BACKGROUND OF THE INVENTION

1. Field of the Invention

The present invention relates to an electroconductive endless belt (hereinafter also simply referred to as "belt"). The endless belt is used when a toner image is transferred to a recording medium such as paper in an electrostatic recording process performed in an electrostatic recording apparatus or an electrophotographic apparatus such as a copying machine or a printer. The toner image is formed by supplying a developer onto the surface of an image-forming member such as a latent image bearing member bearing a latent image thereon.

2. Description of the Related Art

In an electrostatic recording process performed typically in a copying machine or a printer, printing is performed by the steps of uniformly electrifying the surface of a photosensitive member (latent image bearing member), forming an electrostatic latent image by projecting an optical image from an optical system onto this photosensitive member to diselectrify the area to which light is applied, then supplying toner to this electrostatic latent image to form a toner image by electrostatic adhesion of the toner, and transferring the toner image to a recording medium such as paper, transparent paper for overhead projector use, or photographic paper.

Also in a color printer or color copying machine, the printing is fundamentally performed in accordance with the process described above. However, a color printing process uses four color toners, magenta, yellow, cyan, and black for reproducing a color tone and further includes a step of overlapping the color toners at a predetermined ratio. Various methods have been proposed in order to execute this step.

Such methods include, for example, image-on-image development method as a first category. In this method, the above four color toners, magenta, yellow, cyan, and black, are sequentially supplied onto a photosensitive member so as to be superimposed for development in order to convert an electrostatic latent image into a visible color toner image, as in monochromatic printing. An apparatus according to this technique can have a relatively small size. However, it is very difficult to control the gradation, and as a result, a high quality image may not be obtained.

A second category is a tandem system using four photosensitive drums. In this method, four photosensitive drums are aligned; latent images on the drums are developed by respective color toners, magenta, yellow, cyan, and black to form four toner images of magenta, yellow, cyan, and black; the above respective toner images on the aligned photosensitive drums are then sequentially transferred to a recording medium, such as paper, for superimposing the images thereon and thereby reproducing a color image. By this method, superior images can be obtained; however, the apparatus becomes large and expensive, because the four drums each provided with an electrification mechanism and a development mechanism are aligned.

FIG. 2 shows an example of a printing portion of a tandem image-forming apparatus. Four printing units are provided for respective yellow Y, magenta M, cyan C, and black B toners. The printing units each include a photosensitive drum 1, an electrification roller 2, a developing roller 3, a developing blade 4, a toner supply roller 5, and a cleaning blade 6. The toners are sequentially transferred onto paper transported by a transfer and transport belt 10 which is circularly driven by a drive roller (drive member) 9, thereby forming a color image. Electrification and diselectrification of the transfer and transport belt 10 are performed by an electrification roller 7 and a diselectrification roller 8, respectively. The apparatus further includes an attraction roller (not shown) for electrification of paper to attract it by the belt. By the structure described above, the generation of ozone can be suppressed. The attraction roller transfers paper from a transport path onto the transfer and transport belt 10 and also fixes it thereon by electrostatic attraction. In addition, a transfer voltage is decreased after the transfer to decrease an attraction force between paper and the transfer and transport belt 10 so that paper can be separated from the transfer and transport belt only by means of self stripping.

Materials for the transfer and transport belt 10 include a resistive material and a dielectric material; however, each material has advantages and disadvantages. Since a resistive belt retains charges for a short period of time when being used for transfer operation of the tandem system, charge injection caused by the transfer is low, and even by continuous transfer operation of the four colors, the increase in voltage is relatively small. In addition, even when being used repeatedly for the following paper, the resistive belt releases charges, and electrical reset is not required. However, since the electrical resistance of the resistive belt varies with the change in environmental conditions, the transfer efficiently varies, and/or the thickness and the width of paper adversely affect the transfer performance.

In contrast, a dielectric belt is not so configured to release injected changes spontaneously and is thereby configured to electrically control injection and release of charges. However, attraction of paper is reliably performed, and highly precise paper transport can be performed, because the dielectric belt can stably retain charges. In addition, the dielectric constant less varies depending on temperature and humidity, and a relatively stable transfer process may be performed in various environments. As disadvantages, the increase in transfer voltage may be mentioned which is caused by accumulation of charges in the belt as the transfer is repeatedly performed.

A third category is a transfer drum method. In this method, a recording medium such as paper is wound around a transfer drum, and the drum is allowed to rotate four times. During this rotation, magenta, yellow, cyan, and black toners provided on photosensitive members are sequentially transferred on the medium at respective rotations of the drum, thereby reproducing a color image. According to this method, a relatively high quality image can be obtained. However, when a thick recording medium such as a postcard is used, it is difficult to wind the medium around the transfer drum, and the type of recording medium is disadvantageously limited.

In addition to the image-on-image development method, the tandem system, and the transfer drum method, an intermediate transfer system has been proposed as a method in which a high image quality can be obtained, the size of the apparatus is not particularly increased, and the type of recording medium is not particularly limited.

That is, according to this intermediate transfer system, an intermediate transfer member is provided which is composed of a belt and drums designed to temporarily retain toner images transferred from respective four photosensitive members, and four photosensitive members having a magenta toner image, a yellow toner image, a cyan toner image, and a black toner image are disposed around this intermediate transfer member. In the structure described above, the four color toner images are sequentially transferred onto the intermediate transfer member to form a color image thereon, and this color image is then transferred onto a recording medium such as paper. Accordingly, a high image quality can be obtained, because the gradation is adjusted by superimposing the four toner images. The size of the apparatus is not particularly increased, because the photosensitive members are not necessarily aligned, unlike the tandem system. The type of recording medium is therefore not specifically limited, because the recording medium is not required to be wound around the drum.

FIG. 3 shows an image-forming apparatus using an endless belt as the intermediate transfer member by way of example of an apparatus forming a color image in accordance with the intermediate transfer system.

The apparatus shown in FIG. 3 includes a drum-shaped photosensitive member 11 which is allowed to rotate in the direction shown by the arrow in FIG. 3. The photosensitive member 11 is electrified by a primary electrifier 12, a part of the member 11 exposed to an image exposure 13 is then diselectrified thereby, an electrostatic latent image corresponding to a first color component is subsequently formed on the photosensitive member 11, the electrostatic latent image is further developed by a developer 41 using a magenta toner M which is the first color, and as a result, the first-color magenta toner image is formed on the photosensitive member 11. Next, this toner image is transferred onto an intermediate transfer member 20 circularly driven by a drive roller (drive member) 30 while it is being in contact with the photosensitive member 11. In this case, the transfer from the photosensitive member 11 to the intermediate transfer member 20 is performed at a nip portion formed therebetween by a primary transfer bias applied from a power source 61 to the intermediate transfer member 20. After the first-color magenta toner image is transferred onto this intermediate transfer member 20, the surface of the photosensitive member 11 is cleaned by a cleaning device 14, and a first development and transfer operation of the photosensitive member 11 is complete. Subsequently, while the photosensitive member 11 is allowed to rotate three times, at the respective rotations, a second-color cyan toner image, a third-color yellow toner image, and a fourth-color black toner image are sequentially formed in that order on the photosensitive member 11 at the respective rotations by sequentially using developers 42 to 44. Thus, the four color images are superimposed on the intermediate transfer member 20 at the respective rotations, and a composite color toner image corresponding to an object color image is formed on the intermediate transfer member 20. In the apparatus shown in FIG. 3, at the respective rotations of the photosensitive member 11, the positions of the developers 41 to 44 are changed so that development of magenta toner M, cyan toner C, yellow toner Y, and black toner B are sequentially performed.

Next, a transfer roller 25 is then brought into contact with the intermediate transfer member 20 provided with the composite color toner image thereon, and to a nip portion therebetween, a recording medium 26 is supplied from a paper feed cassette 19. At the same time, a power source 29 applies a secondary transfer bias to the transfer roller 25, and the composite color toner image is transferred from the intermediate transfer member 20 onto the recording medium 26, followed by heating and fixing, thereby forming a final image. After the composite color toner image is transferred onto the recording medium 26, the intermediate transfer member 20 is processed by a cleaning device 35 so as to remove residual toners remaining on the surface and is then placed in a standby state for another image formation.

An intermediate transfer system as a combination between the tandem system and the intermediate transfer system has also been proposed. FIG. 4 shows an image-forming apparatus in accordance with an intermediate transfer system by way of example. In the method, color image formation is performed using an endless belt-shaped intermediate transfer member.

In the apparatus shown in FIG. 4, a first, second, third, and fourth development portions 54*a*, 54*b*, 54*c*, and 54*d* are sequentially disposed along an intermediate transfer member 50 for developing electrostatic latent images on photosensitive drums 52*a*, 52*b*, 52*c*, and 52*d* using yellow, magenta, cyan, and black toners, respectively, and this intermediate transfer member 50 is circularly driven in the direction indicated by the arrow shown in FIG. 4, so that four color toner images formed on the photosensitive drums 52*a* to 52*d* of the respective development portions 54*a* to 54*d* are sequentially transferred on this intermediate transfer member 50 to form a color toner image thereon. Subsequently, the formed toner image is transferred onto a recording medium 53 such as paper by transfer, thereby performing printout. In any apparatus described above, arrangement order of toners to use for the developing is not specifically limited and can be selected appropriately.

The apparatus shown in FIG. 4 further includes a drive roller or a tension roller 55 configured to circularly drive the intermediate transfer member 50; a recording medium feed roller 56; a recording medium feed device 57; a fixing device 58 configured to fix an image on the recording medium typically by heating; and a power source device (voltage application means) 59 configured to apply a voltage to the intermediate transfer member 50. The power source device 59 is configured to change the application direction of the voltage between the case where the toner image is transferred onto the intermediate transfer member 50 from the photosensitive drums 52*a* to 52*d* and the case where the toner image is transferred from the intermediate transfer member 50 to the recording medium 53.

Heretofore, such an electroconductive endless belt for use as the transfer and transport endless belt 10 or the endless intermediate transfer member 20 or 50 has generally been a semiconductive resin film belt or a fiber-reinforced rubber belt. Examples of the resin for use in the resin film belt include polycarbonate (PC) mixed with carbon black, polyalkylene terephthalate-based resins, and thermoplastic polyimide-based resins.

Japanese Unexamined Patent Application Publication No. 6-93175 discloses, for the purpose of providing a flame-resistant resin having high thermal stability, a flame-resistant seamless belt for use in intermediate transfer that is composed of polycarbonate as a main component, a polyalkylene terephthalate, carbon black, a flame retardant, an antimony compound, and a polyolefin. Japanese Unexamined Patent Application Publication No. 10-237278 discloses, for the purpose of providing an electroconductive seamless belt having high flexibility, a seamless belt composed of a thermoplastic resin combining a polyester, a polyester elastomer, an electroconductive filler, and a bromine-containing flame retardant. Japanese Unexamined Patent Application Publication No. 5-213504 discloses, for the purpose of providing a flame-resistant, highly durable electroconductive seamless belt, a seamless belt having a layer containing carbon black and a flame retardant and a durable outer layer containing carbon black and no flame retardant.

However, as disclosed in the above-mentioned patent documents, in known flame-resistant belts containing a flame retardant, the dispersibility of the flame retardant has never been investigated and is insufficient. In particular, in an example in Japanese Unexamined Patent Application Publication No. 10-237278, the dispersion of a flame retardant, a TBBA carbonate oligomer, in polybutylene terephthalate is insufficient, and the resulting belt is likely to have poor surface properties. Insufficiently dispersed particles of a flame retardant form a granular structure on a belt, causing image defects. Excellent dispersion of a flame retardant in a resin component is therefore important and is desired. The belt disclosed in Japanese Unexamined Patent Application Publication No. 6-93175 is mainly composed of a non-crystalline resin, polycarbonate, and has low durability, as indicated by the hinge property (fracture characteristic) of only several hundred times evaluated in an example. Thus, the belt cannot satisfy required characteristics.

SUMMARY OF THE INVENTION

Accordingly, it is an object of the present invention to solve the problems described above in related art and provide an electroconductive endless belt that has high elasticity, high durability, and flame retardance, as well as excellent surface properties.

As a result of extensive research, the present inventor perfected the present invention by discovering that an electroconductive endless belt having high elasticity, high durability, and flame retardance, as well as excellent surface properties can be manufactured by constructing a multilayer structure including inside a base layer that contains a particular flame retardant in a particular resin component.

According to one aspect of the present invention, an electroconductive endless belt for use as an intermediate transfer member that is disposed between an image-forming unit and a recording medium, is circularly driven by a drive unit, and temporarily holds a toner image transferred from the image-forming unit and subsequently transfers the toner image onto the recording medium, wherein the electroconductive endless belt has a multilayer structure including at least a surface layer disposed on a base layer, and the base layer is mainly composed of a polyester resin and/or a polyester elastomer and contains a conductive agent, a brominated epoxy resin, and an antimony compound, the polyester elastomer having a melting point of at least 210° C.

According to another aspect of the present invention, an electroconductive endless belt for use in a tandem transfer and transport system that is circularly driven by a drive unit to transport a recording medium held on the electroconductive endless belt by electrostatic adsorption through a plurality of image-forming units so that toner images formed on the image-forming units are sequentially transferred onto the recording medium, wherein the electroconductive endless belt has a multilayer structure including at least a surface layer disposed on a base layer, and the base layer is mainly composed of a polyester resin and/or a polyester elastomer and contains a conductive agent, a brominated epoxy resin, and an antimony compound, the polyester elastomer having a melting point of at least 210° C.

Preferably, the brominated epoxy resin is terminated with tribromophenol. Preferably, the brominated epoxy resin is derived from tetrabromobisphenol A.

Preferably, the surface layer is mainly composed of a polyester resin and/or a polyester elastomer, the polyester elastomer having a melting point of at least 210° C. Preferably, the surface layer contains a brominated epoxy resin and/or an antimony compound. Preferably, the average particle size of the antimony compound in the surface layer is 2 μm or less.

Accordingly, the present invention can provide an electroconductive endless belt having high elasticity, high durability, and flame retardance, as well as excellent surface properties.

DESCRIPTION OF THE PREFERRED EMBODIMENTS

Preferred embodiments of the present invention will be described in detail below.

Electroconductive endless belts are roughly divided into jointed endless belts and un-jointed endless belts (so-called seamless belts). An electroconductive endless belt according to the present invention may be of either type and is preferably a seamless belt. As described above, an electroconductive endless belt according to the present invention can be used as a transfer member in a tandem system and an intermediate transfer system.

Figure 2:
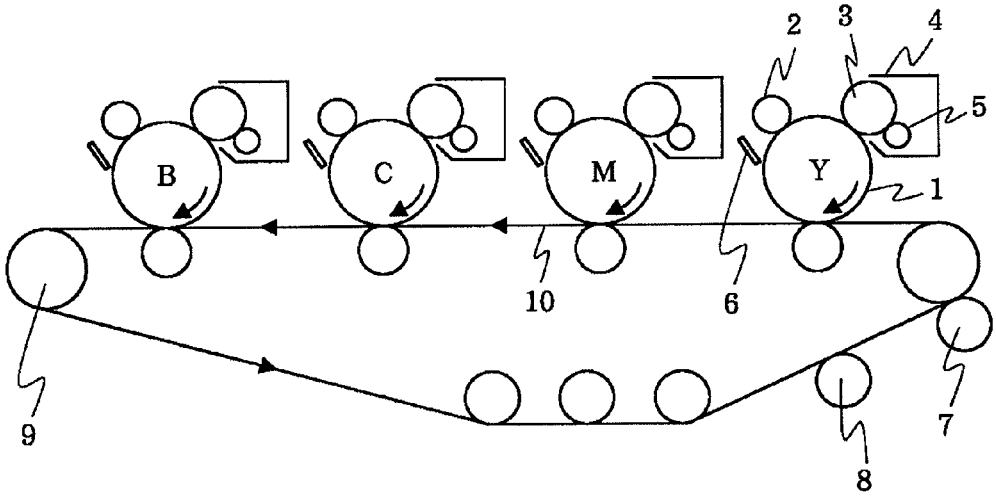
FIG. 2 is a schematic view of a tandem image-forming apparatus that includes a transfer and transport belt, as an example of an image-forming apparatus according to the present invention.

As illustrated in FIG. 2, when an electroconductive endless belt according to the present invention is a transfer and transport belt 10, the endless belt is driven by a drive unit, such as drive rollers 9, to sequentially transfer toners onto a recording medium transported on the endless belt, thus forming a color image.

Figure 3:
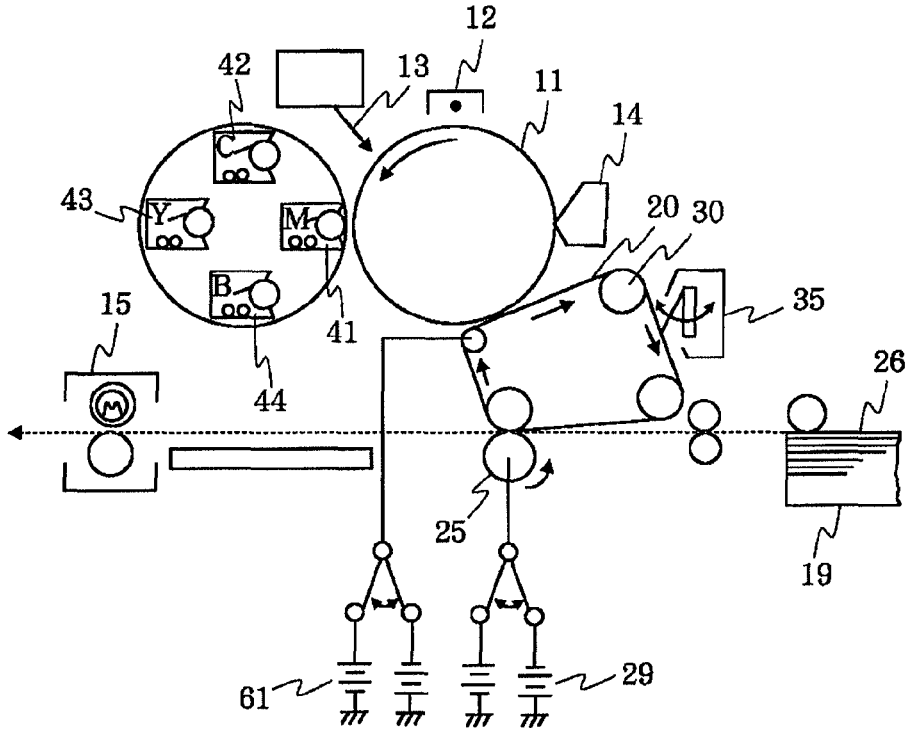
FIG. 3 is a schematic view of an intermediate transfer apparatus that includes an intermediate transfer member, as another example of an image-forming apparatus according to the present invention.

As illustrated in FIG. 3, when an electroconductive endless belt according to the present invention is an intermediate transfer member 20, the endless belt is circularly driven by a drive unit, such as drive rollers 30, between a photosensitive drum (latent image carrier) 11 and a recording medium 26, such as a piece of paper, to temporarily transfer a toner image formed on the photosensitive drum 11 onto the endless belt and subsequently transfer the toner image onto the recording medium 26. As described above, the apparatus illustrated in FIG. 3 performs color printing by the intermediate transfer system.

Figure 4:
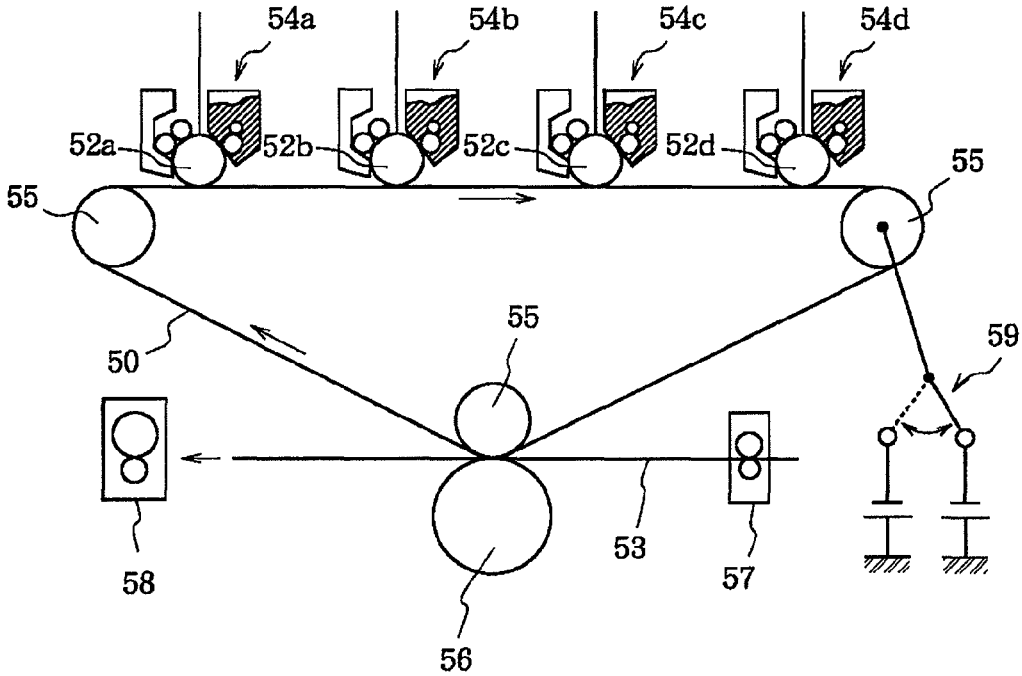
FIG. 4 is a schematic view of another intermediate transfer apparatus that includes an intermediate transfer member, as still another example of an image-forming apparatus according to the present invention.

As illustrated in FIG. 4, when an electroconductive endless belt according to the present invention is an intermediate transfer member 50, the endless belt is circularly driven by a drive unit, such as drive rollers 55, between developing units 54*a* to 54*d* including photosensitive drums 52*a* to 52*d* and a recording medium 53, such as a piece of paper, to temporarily transfer four color toner images formed on the respective photosensitive drums 52*a* to 52*d* onto the endless belt and then transfer them onto the recording medium 53, thus forming a color image. The number of color toners is not limited to four and may be any number.

Figure 1:
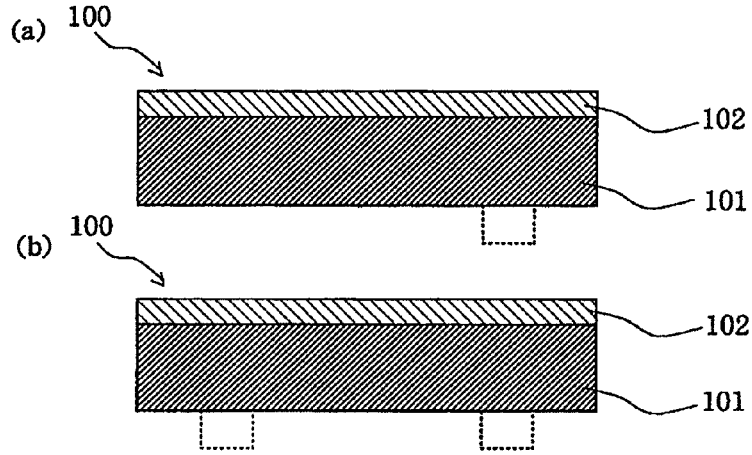
FIG. 1 is a transverse cross-sectional view of an electroconductive endless belt according to an embodiment of the present invention.

FIG. 1 is a transverse cross-sectional view of an electroconductive endless belt according to a preferred embodiment of the present invention. An electroconductive endless belt 100 according to the present invention has a multilayer structure including at least a surface layer 102 disposed on a base layer 101. The base layer 101 is mainly composed of a polyester resin and/or a polyester elastomer and contains a conductive agent, a brominated epoxy resin, and an antimony compound. The polyester elastomer has a melting point of at least 210° C.

While the flame retardant in the base layer 101 imparts flame retardance to the belt, the surface layer 102 prevents the deterioration of the surface properties due to the flame retardant. Thus, an electroconductive endless belt according to the present invention has better surface properties than monolayer belts.

As described above, the base layer 101 has the function of imparting flame retardance to a belt according to the present invention. To perform the function properly, the thickness of the base layer 101 ranges preferably from 70% to 99% and more preferably from 80% to 99% of the total thickness of the belt.

Examples of the polyester resin for use in the base layer 101 include, but not limited to, thermoplastic polyalkylene naphthalate resins, such as a polyethylene naphthalate (PEN) resin and a polybutylene naphthalate (PBN) resin, and thermoplastic polyalkylene terephthalate resins, such as a polyethylene terephthalate (PET) resin, a glycol-modified polyethylene terephthalate (PETG) resin, and a polybutylene terephthalate (PBT) resin. These polyester resins may be used in combination.

The polyester elastomer may be any polyester elastomer having a melting point of at least 210° C. and preferably in the range of 210° C. to 250° C. Preferred examples of the polyester elastomer include those composed of a polyester hard segment and a polyester soft segment and those composed of a polyester hard segment and a polyether soft segment. While a hard segment of polyester elastomers generally contains polybutylene terephthalate (PBT) or polybutylene naphthalate (PBN) as a main component, either may be used in the present invention. These polyester elastomers may be used in combination. A polyester elastomer having a melting point below 210° C. has an insufficient modulus of elasticity in tension.

The base layer 101 may be the polyester resin or the polyester elastomer having a melting point of at least 210° C., or a combination thereof at an appropriate ratio depending on the application.

The polyester resin and the polyester elastomer having a melting point of at least 210° C. have a tendency to be hydrolyzed by heat in a forming process. Thus, a carbodiimide compound is preferably added to the polyester resin or the polyester elastomer to crosslink hydrolyzed polyester or polyester elastomer fragments through the reaction between a carbodiimide group and a carboxyl group, thus preventing a reduction in molecular weight. This can prevent the embrittlement of the belt and improve the crack resistance of the belt for a long period of time. The carbodiimide compound is commercially available and is, for example, Carbodilite (trade name) manufactured by Nisshinbo Industries, Inc. The carbodiimide compound may be in the form of a masterbatch pellet, for example, Carbodilite (trade name) E pellet or B pellet manufactured by Nisshinbo Industries, Inc.

The amount of the carbodiimide compound is, but not limited to, preferably in the range of 0.05 to 30 parts by weight and more preferably in the range of 0.1 to 5 parts by weight per 100 parts by weight of the polyester resin and/or the polyester elastomer.

The brominated epoxy resin for use as a flame retardant in the present invention may be any general-purpose brominated epoxy resin and is preferably derived from tetrabromobisphenol A. The brominated epoxy resin is highly compatible with and highly dispersible in the polyester resin or the polyester elastomer. To achieve consistent flame retardance, the amount of the brominated epoxy resin in the base layer 101 ranges preferably from 1 to 30 parts by weight and more preferably from 5 to 20 parts by weight per 100 parts by weight of the polyester resin and/or the polyester elastomer. An excess of brominated epoxy resin reduces the physical properties of the belt and may cause problems, such as cracking.

Preferably, the brominated epoxy resin is terminated with tribromophenol. This improves the thermal stability of the brominated epoxy resin. More specifically, the viscosity of a brominated epoxy resin not terminated with tribromophenol may be increased by the reaction with the polyester resin or the polyester elastomer, or may gel while remaining in a molding machine for a long period of time, resulting in unstable melt flowability.

A belt according to the present invention further contains an antimony compound as a flame retardant aid. The addition of the antimony compound can efficiently reduce the amount of the brominated epoxy resin required to achieve intended flame retardance. Examples of the antimony compound include an antimony trioxide ($Sb_2O_3$), antimony tetraoxide ($Sb_2O_4$), antimony pentoxide ($Sb_2O_5$), and sodium antimonate. For example, antimony trioxide may be used at a brominated epoxy resin/antimony trioxide ratio in the range of 95/5 to 50/50 and preferably in the range of 90/10 to 60/40.

The combined use of the brominated epoxy resin and the antimony compound in the base layer 101 allows a belt according to the present invention to achieve flame retardance of VTM-2 or a higher level in accordance with UL 94 standards. The base layer 101 may further contain another bromine-containing flame retardant or flame retardant aid provided that the advantages of the present invention are not compromised.

A resin component serving as the main component of the surface layer 102 in a belt according to the present invention may be, but not limited to, a thermoplastic resin or a thermoplastic elastomer known as a belt material, used alone or in combination.

Examples of the thermoplastic resin include polyester resins, such as thermoplastic polyalkylene naphthalate resins (for example, a polyethylene naphthalate (PEN) resin and a polybutylene naphthalate (PBN) resin) and thermoplastic polyalkylene terephthalate resins (for example, a polyethylene terephthalate (PET) resin, a glycol-modified polyethylene terephthalate (PETG) resin, and a polybutylene terephthalate (PBT) resin); thermoplastic polyamides (PAs) (for example, PA11, PA12, PA6, PA66, PA610, PA612, PA46, and aromatic nylons (for example, nylon 6T, 9T, and MXD6)); an acrylonitrile-butadiene-styrene (ABS) resin; thermoplastic polyacetal (POM); thermoplastic polyarylate (PAR); thermoplastic polycarbonate (PC); and polyolefin resins, such as polyethylene (PE) and polypropylene (PP)).

Examples of the thermoplastic elastomer include polyester elastomers, polyamide elastomers, polyether elastomers, polyolefin elastomers, polyurethane elastomers, polystyrene elastomers, polyacrylic elastomers, and polydiene elastomers. Among them, thermoplastic polyester elastomers are preferred. Preferred examples of the thermoplastic polyester elastomers include polyester-polyester elastomers having a polyester hard segment and a polyester soft segment and polyester-polyether elastomers having a polyester hard segment and a polyether soft segment. While a hard segment of polyester elastomers generally contains polybutylene terephthalate (PBT) or polybutylene naphthalate (PBN) as a main component, either may be used in the present invention.

In particular, use of the polyester resin and/or the polyester elastomer having a melting point of at least 210° C. as the resin component in the surface layer 102 can improve the surface properties and the adhesion between the surface layer 102 and the base layer 101, and is therefore preferred. The polyester elastomer having a melting point of at least 210° C. for use in the surface layer 102 may be the same as in the base layer 101.

Preferably, the surface layer 102 contains a brominated epoxy resin and/or an antimony compound to improve the flame retardance of a belt according to the present invention. When the flame retardant is a brominated epoxy resin, the surface layer 102 can contain the flame retardant without the deterioration of the surface properties. The brominated epoxy resin for use in the surface layer 102 may be the same as in the base layer 101.

Depending on the thickness of the surface layer 102, the amount of the brominated epoxy resin in the surface layer 102 ranges preferably from 1 to 30 parts by weight and more preferably from 5 to 20 parts by weight per 100 parts by weight of the polyester resin and/or the polyester elastomer, as in the base layer 101. According to the present invention, the surface layer 102 may not contain a brominated epoxy resin. Thus, even if the brominated epoxy resin in the surface layer 102 is insufficient to achieve complete flame retardance, as long as it improves the flame retardance as a whole, that is sufficient for the present invention.

The antimony compound in the surface layer 102 preferably has an average particle size of 2 μm or less, particularly in the range of 0.1 to 1.5 μm, to maintain excellent surface properties. The thickness of the surface layer 102 in a belt according to the present invention ranges preferably from 1% to 30% and more preferably from 1% to 20% of the total thickness of the belt.

The surface layer 102 may further contain another bromine-containing flame retardant or flame retardant aid provided that the advantages of the present invention are not compromised.

While a belt according to the present invention has a multilayer structure that includes a surface layer disposed on a base layer, the belt may include an additional layer between the base layer and the surface layer or under the base layer. For example, the layer having the same structure as the surface layer may be formed under the base layer. An adhesive layer may be formed between the base layer and the surface layer.

The layers of a belt according to the present invention may contain a conductive agent to control the electrical conductivity. The conductive agent may be, but not limited to, a known electroconductive agent, a known ion carrier, or a known polymer ion carrier. Examples of the electroconductive agent include electroconductive carbon, such as ketjen black and acetylene black; carbon for rubber, such as SAF, ISAF, HAF, FEF, GPF, SRF, FT, and MT; oxidized carbon for color inks; pyrolytic carbon; natural graphite; synthetic graphite; metal and metal oxides, such as antimony-doped tin oxide, titanium oxide, zinc oxide, nickel, copper, silver, and germanium; electroconductive polymers, such as polyaniline, polypyrrole, and polyacetylene; and electroconductive whiskers, such as carbon whisker, graphite whisker, titanium carbide whisker, electroconductive potassium titanate whisker, electroconductive barium titanate whisker, electroconductive titanium oxide whisker, and electroconductive zinc oxide whisker. Examples of the ion carrier include ammonium salts of perchlorates, chlorates, hydrochlorides, bromates, iodates, fluoroborates, sulfates, ethylsulfates, carboxylates, and sulfonates, such as tetraethylammonium, tetrabutylammonium, dodecyltrimethylammonium, hexadecyltrimethylammonium, benzyltrimethylammonium, and modified fatty acid dimethylethylammonium; and perchlorates, chlorates, hydrochlorides, bromates, iodates, fluoroborates, sulfates, trifluoromethylsulfates, and sulfonates of alkali metals and alkaline earth metals, such as lithium, sodium, potassium, calcium, and magnesium.

The polymer ion carrier may be, but not limited to, a polymer ion carrier described in Japanese Unexamined Patent Application Publication No. 9-227717, No. 10-120924, No. 2000-327922, or No. 2005-60658.

More specifically, the polymer ion carrier may be a mixture of (A) an organic polymer material, (B) an ion conductive polymer or copolymer, and (C) an inorganic or low molecular weight organic salt. The component (A) may be polyacrylate, polymethacrylate, polyacrylonitrile, polyvinyl alcohol, polyvinyl acetate, polyamide, such as polyamide 6 or polyamide 12, polyurethane, or polyester. The component (B) may be an oligoethoxylated acrylate or methacrylate, polystyrene in which the aromatic ring is oligoethoxylated, polyether urethane, polyether urea, polyetheramide, polyetheresteramide, or a polyester-ether block copolymer. The component (C) may be an alkali metal, alkaline earth metal, zinc, or ammonium salt of an inorganic or low molecular weight organic protonic acid and is preferably $LiClO_4$, $LiCF_3SO_3$, $NaClO_4$, $LiBF_4$, $NaBF_4$, $KBF_4$, $NaCF_3SO_3$, $KClO_4$, $KPF_6$, $KCF_3SO_3$, $KC_4F_9SO_3$, $Ca(ClO_4)_2$, $Ca(PF_6)_2$, $Mg(ClO_4)_2$, $Mg(CF_3SO_3)_2$, $Zn(ClO_4)_2$, $Zn(PF_6)_2$, or $Ca(CF_3SO_3)_2$.

Preferably, the component (B) is polyetheramide, polyetheresteramide, or a polyester-ether block copolymer. Preferably, the component (C) is a low-molecular ion carrier. More preferably, in such a polyetheramide and polyetheresteramide, the polyether component contains a ($CH_2$—$CH_2$—O) segment, and the polyamide component contains polyamide 12 or polyamide 6. More preferably, the low-molecular ion carrier of the component (C) is $NaClO_4$. Such a polymer ion carrier is commercially available (for example, Irgastat (registered trademark) P18 and P22 (Chiba Specialty Chemicals, Inc.).

Another preferred polymer ion carrier is a block copolymer composed of a polyolefin segment and a hydrophilic polymer segment alternately linked by an ester, amide, ether, urethane, or imide bond. Examples of the polyolefin segment include polyolefins, preferably polypropylene and polyethylene, having functional groups, such as a carboxyl group, a hydroxyl group, and an amino group, at both ends of a polymer.

Examples of the hydrophilic polymer segment include polyether diols, such as polyoxyalkylene having a hydroxyl group; polyetheresteramide produced from a polyamide having carboxyl groups at both ends and a polyether diol; polyetheramideimide composed of a polyamideimide and a polyether diol; polyetherester composed of polyester and polyether diol; and polyetheramide composed of polyamide and polyether diamine. Among others, polyoxyalkylene having a hydroxyl group, such as polyoxyethylene (polyethylene glycol) and polyoxypropylene (polypropylene glycol) each having hydroxyl groups at both ends, is preferred.

The block copolymer for use as the polymer ion carrier is commercially available, for example, as Pelestat (trade name) 230, 300, and 303 (manufactured by Sanyo Chemical Industries, Ltd.). A mixture of the block copolymer and a lithium compound $LiCF_3SO_3$ can have an antistatic effect at a lower additive level. Such a mixture is commercially available, for example, as Sankonol (trade name) TBX-310 (manufactured by Sanko Chemical Industry Co., Ltd.).

When the conductive agent is a polymer ion carrier, a compatibilizer may be used to increase the compatibility of the polymer ion carrier with a base resin.

These conductive agents may be used alone or in combination. For example, a combination of an electroconductive agent and an ion carrier allows the belt to have consistent electrical conductivity, independent of variations in applied voltage or environment.

The amount of the electroconductive agent is typically 100 parts by weight or less, for example, 1 to 100 parts by weight, preferably 1 to 80 parts by weight, and more preferably 5 to 50 parts by weight per 100 parts by weight of resin component. The amount of the ion carrier ranges typically from 0.01 to 10 parts by weight and preferably from 0.05 to 5 parts by weight per 100 parts by weight of resin component. The amount of the polymer ion carrier ranges typically from 1 to 500 parts by weight and preferably from 10 to 400 parts by weight per 100 parts by weight of resin component. Preferably, in the present invention, the conductive agent is 5 to 30 parts by weight of carbon black per 100 parts by weight of resin component.

In addition to the components described above, an electroconductive endless belt according to the present invention can contain another functional component, such as a filler, a coupling agent, an antioxidant, a lubricant, a surface-treating agent, a pigment, a ultraviolet absorber, an antistatic agent, a dispersant, a neutralizing agent, a foaming agent, and/or a cross-linker, without compromising the advantages of the present invention. A coloring agent may further be added to the belt for coloring.

An electroconductive endless belt according to the present invention may have any thickness depending on the form of the transfer and transport belt or the intermediate transfer member. Preferably, the thickness of the belt ranges from 50 to 200 μm. The surface roughness of the belt is preferably 10 μm or less, more preferably 6 μm or less, and still more preferably 3 μm or less, as determined by ten-point height of irregularities Rz in conformity to Japanese Industrial Standards (JIS).

As indicated by an alternate long and short dashed line in FIG. 1, an electroconductive endless belt according to the present invention may have a fitting part to be engaged with a fitting part (not shown) of a drive unit, such as the drive rollers 9 in the image-forming apparatus illustrated in FIG. 2 or the drive rollers 30 illustrated in FIG. 3. An electroconductive endless belt having such a fitting part can be driven without shifting in the width direction of the belt.

While the fitting part may have any shape, preferably, it is a raised line extending in the circumferential direction (rotation direction) of the belt, as illustrated in FIG. 1, and the raised line is fitted into a recessed line formed in the circumferential direction of a drive unit, such as a drive roller, in the circumferential direction.

While a single raised line is formed as the fitting part in FIG. 1(*a*), the fitting part may be composed of a plurality of raised parts aligned in the circumferential direction (rotation direction) of the belt. The belt may have two fitting parts (FIG. 1(*b*)) or a fitting part in the middle of the width of the belt. Alternatively, a recessed line formed as a fitting part in the belt in the circumferential direction (rotation direction) may be fitted onto a raised line formed on a drive unit, such as a drive roller, in the circumferential direction.

An electroconductive endless belt according to the present invention can suitably be manufactured by coextrusion of each layer of the multilayer structure while ensuring the adhesion therebetween. For example, in the coextrusion of a belt having two layers, a base layer material melted from one extruder and a surface layer material melted from the other extruder are simultaneously fed into a two-layer ring die. Thus, a laminated belt can be manufactured in a single process for a short period of time. For a belt having three or more layers, the number of extruders depends on the number of layers. The flow path in the die may be modified such that the number of layers is larger than the number of materials. A belt according to the present invention may be manufactured by powder coating, such as electrostatic powder coating, dipping, or centrifugal molding.

EXAMPLES

The present invention will be described in more detail with reference to the following examples.

Electroconductive endless belts according to Examples and Comparative Examples were manufactured. Tables 1 to 4 show the composition of the belts in parts by weight. More specifically, the components of each layer melt-kneaded in twin-screw kneaders were extruded through a two-layer cylindrical die to form an electroconductive endless belt having an inner diameter of 155 mm, a total thickness of 100 μm (a surface layer of 10 μm and a base layer of 90 μm), and a width of 250 mm. The amounts of carbon black in the base layer and the surface layer were adjusted so that the belt had a volume resistivity of $10^9$ Ω·cm and a surface resistivity of $10^9$ ohm per square.

The belts manufactured in Examples and Comparative Examples were evaluated according to the following procedures. Tables 1 to 4 show the results.

Measurement of Modulus of Elasticity in Tension

The modulus of elasticity in tension was measured under the following conditions.

Apparatus: Shimadzu Corporation, tensile tester EZ test (analysis software: Trapezium)

Sample: strip (100 mm in length×10 mm in width×100 μm in standard thickness)

Rate of pulling: 5 mm/s

Data sampling interval: 100 ms

Measuring method: inclination at an elongation in the range of 0.5% to 0.6% (according to JIS tangent method)

Measurement environment: room temperature (23° C.±3° C.), 55%±10% RH

Evaluation of Surface Properties

Image defects caused by a granular structure on the surface of a belt were evaluated using the belt as an intermediate transfer belt in a color laser printer illustrated in FIG. 3. In the tables, "pass" means the absence of an image defect, and "fail" means the presence of an image defect.

Evaluation of Flame Retardance

Flame retardance was evaluated in accordance with UL 94 standards.

TABLE 1

| | | | Example 1 | Example 2 | Example 3 | Example 4 | Example 5 |
|---|---|---|---|---|---|---|---|
| Surface layer | Thermoplastic resin | PBT*1) | 100 | 100 | — | — | — |
| | | PBN*2) | — | — | 100 | 100 | 100 |
| | Thermoplastic elastomer | Polyester elastomer(2)*8) | — | — | — | — | — |

TABLE 1-continued

| | | | Example 1 | Example 2 | Example 3 | Example 4 | Example 5 |
|---|---|---|---|---|---|---|---|
| | Conductive agent | Carbon black*3) | 12 | 12 | 12 | 12 | 12 |
| | Flame retardant | TBBA epoxy resin(1)*4) | — | — | — | — | — |
| | | TBBA epoxy resin(2)*5) | — | — | — | — | — |
| | Antimony compound | Antimony trioxide*6) | — | — | — | — | — |
| | Mixing temperature(° C.) | | 250 | 250 | 260 | 260 | 260 |
| Base layer | Thermoplastic resin | PBT*1) | 100 | 100 | 100 | 100 | 100 |
| | Thermoplastic elastomer | Polyester elastomer(1)*7) | — | — | — | — | — |
| | | Polyester elastomer(2)*8) | — | — | — | — | — |
| | Conductive agent | Carbon black*3) | 16 | 17 | 14 | 15 | 15 |
| | Flame retardant | TBBA epoxy resin(1)*4) | 10 | 15 | — | — | — |
| | | TBBA epoxy resin(2)*5) | — | — | 10 | 15 | 15 |
| | Antimony compound | Antimony trioxide*6) | 3 | 5 | 3 | 5 | — |
| | | Sodium antimonate*9) | — | — | — | — | 8 |
| | Mixing temperature(° C.) | | 250 | 250 | 250 | 250 | 250 |
| | Die temperature(° C.) | | 250 | 250 | 260 | 260 | 260 |
| | Modulus of elasticity in tension(MPa) | | 2200 | 2300 | 2100 | 2200 | 2200 |
| | Surface properties | | Pass | Pass | Pass | Pass | Pass |
| | Flame retardance | | VIM-2 | VIM-0 | VIM-2 | VIM-0 | VIM-1 |

*1)PBT: Polyplastics Co., Ltd., Duranex (trade name) 800FP (melting point: 222° C.)
*2)PBN: Teijin Chemicals Ltd., TQB-OT (melting point: 243° C.)
*3)Carbon black: Denki Kagaku Kogyo K.K., granular Denka Black
*4)TBBA epoxy resin (1): Sakamoto Yakuhin Kogyo Co., Ltd., SR-T5000
*5)TBBA epoxy resin (2): Sakamoto Yakuhin Kogyo Co., Ltd., SR-T3040 (terminated with tribromophenol)
*6)Antimony trioxide: Suzuhiro Chemical Co., Ltd., Fire Cut (trade name) AT-3CN (average particle size: 0.4 to 1.5 μm)
*7)Polyester elastomer (1): Toyobo Co., Ltd., Pelprene (trade name) E-450B (melting point: 222° C.)
*8)Polyester elastomer (2): Toyobo Co., Ltd., Pelprene (trade name) EN-16000 (melting point: 241° C.)
*9)Sodium antimonate: Nihon Seiko Co., Ltd., SA-A (average particle size: 5 μm)

TABLE 2

| | | | Example 6 | Example 7 | Example 8 | Example 9 | Example 10 |
|---|---|---|---|---|---|---|---|
| Surface layer | Thermoplastic resin | PBT*1) | — | — | — | — | — |
| | | PBN*2) | 100 | 80 | 60 | — | 100 |
| | Thermoplastic elastomer | Polyester elastomer(2)*8) | — | 20 | 40 | 100 | — |
| | Conductive agent | Carbon black*3) | 12 | 12 | 11 | 10 | 12 |
| | Flame retardant | TBBA epoxy resin(1)*4) | — | — | — | — | — |
| | | TBBA epoxy resin(2)*5) | — | — | — | — | — |
| | Antimony compound | Antimony trioxide*6) | — | — | — | — | — |
| | Mixing temperature(° C.) | | 260 | 260 | 250 | 250 | 260 |
| Base layer | Thermoplastic resin | PBT*1) | 80 | 80 | 80 | 80 | 60 |
| | Thermoplastic elastomer | Polyester elastomer(1)*7) | 20 | 20 | 20 | 20 | 40 |
| | | Polyester elastomer(2)*8) | — | — | — | — | — |
| | Conductive agent | Carbon black*3) | 14 | 14 | 14 | 14 | 14 |
| | Flame retardant | TBBA epoxy resin(1)*4) | — | — | — | — | — |
| | | TBBA epoxy resin(2)*5) | 15 | 15 | 15 | 15 | 15 |
| | Antimony compound | Antimony trioxide*6) | 5 | 5 | 5 | 5 | 5 |
| | | Sodium antimonate*9) | — | — | — | — | — |
| | Mixing temperature(° C.) | | 240 | 240 | 240 | 240 | 240 |
| | Die temperature(° C.) | | 260 | 260 | 250 | 250 | 260 |
| | Modulus of elasticity in tension(MPa) | | 2000 | 1900 | 1800 | 1600 | 1800 |
| | Surface properties | | Pass | Pass | Pass | Pass | Pass |
| | Flame retardance | | VIM-0 | VIM-0 | VIM-0 | VIM-0 | VIM-0 |

TABLE 3

| | | | Example 11 | Example 12 | Example 13 | Example 14 | Example 15 |
|---|---|---|---|---|---|---|---|
| Surface layer | Thermoplastic resin | PBT*1) | — | — | — | — | — |
| | | PBN*2) | 100 | 100 | 100 | 100 | 100 |
| | Thermoplastic elastomer | Polyester elastomer(2)*8) | — | — | — | — | — |
| | Conductive agent | Carbon black*3) | 12 | 12 | 12 | 12 | 12 |
| | Flame retardant | TBBA epoxy resin(1)*4) | — | — | — | — | — |
| | | TBBA epoxy resin(2)*5) | — | — | — | — | — |

TABLE 3-continued

| | | | Example 11 | Example 12 | Example 13 | Example 14 | Example 15 |
|---|---|---|---|---|---|---|---|
| | Antimony compound | Antimony trioxide*6) | — | — | — | — | — |
| | Mixing temperature(° C.) | | 260 | 260 | 260 | 260 | 260 |
| Base layer | Thermoplastic resin | PBT*1) | 40 | — | 80 | 60 | 40 |
| | Thermoplastic elastomer | Polyester elastomer(1)*7) | 60 | 100 | — | — | — |
| | | Polyester elastomer(2)*8) | — | — | 20 | 40 | 60 |
| | Conductive agent | Carbon black*3) | 13 | 12 | 16 | 15 | 14 |
| | Flame retardant | TBBA epoxy resin(1)*4) | — | — | — | — | — |
| | | TBBA epoxy resin(2)*5) | 15 | 15 | 10 | 10 | 10 |
| | Antimony compound | Antimony trioxide*6) | 5 | 5 | 3 | 3 | 3 |
| | | Sodium antimonate*9) | — | — | — | — | — |
| | Mixing temperature(° C.) | | 235 | 230 | 250 | 250 | 250 |
| | Die temperature(° C.) | | 260 | 260 | 260 | 260 | 260 |
| | Modulus of elasticity in tension(MPa) | | 1600 | 1200 | 1900 | 1700 | 1500 |
| | Surface properties | | Pass | Pass | Pass | Pass | Pass |
| | Flame retardance | | VIM-0 | VIM-2 | VIM-2 | VIM-2 | VIM-2 |

TABLE 4

| | | | Example 16 | Example 17 | Example 18 | Example 19 | Example 20 |
|---|---|---|---|---|---|---|---|
| Surface layer | Thermoplastic resin | PBT*1) | — | 100 | — | — | — |
| | | PBN*2) | 100 | — | 100 | 100 | 100 |
| | Thermoplastic elastomer | Polyester elastomer(2)*8) | — | — | — | — | — |
| | Conductive agent | Carbon black*3) | 13 | 12 | 13 | 12 | 13 |
| | Flame retardant | TBBA epoxy resin(1)*4) | 5 | 5 | — | — | — |
| | | TBBA epoxy resin(2)*5) | — | — | 5 | — | 3 |
| | Antimony compound | Antimony trioxide*6) | — | — | — | 2 | 1 |
| | Mixing temperature(° C.) | | 260 | 250 | 260 | 260 | 260 |
| Base layer | Thermoplastic resin | PBT*1) | 80 | 80 | 80 | 80 | 80 |
| | Thermoplastic elastomer | Polyester elastomer(1)*7) | — | — | — | — | — |
| | | Polyester elastomer(2)*8) | 20 | 20 | 20 | 20 | 20 |
| | Conductive agent | Carbon black*3) | 16 | 16 | 16 | 16 | 16 |
| | Flame retardant | TBBA epoxy resin(1)*4) | — | — | — | — | — |
| | | TBBA epoxy resin(2)*5) | 10 | 10 | 10 | 10 | 10 |
| | Antimony compound | Antimony trioxide*6) | 3 | 3 | 3 | 3 | 3 |
| | | Sodium antimonate*9) | — | — | — | — | — |
| | Mixing temperature(° C.) | | 250 | 250 | 250 | 250 | 250 |
| | Die temperature(° C.) | | 260 | 250 | 260 | 260 | 260 |
| | Modulus of elasticity in tension(MPa) | | 1850 | 2000 | 1850 | 1800 | 1830 |
| | Surface properties | | Pass | Pass | Pass | Pass | Pass |
| | Flame retardance | | VIM-1 | VIM-1 | VIM-1 | VIM-1 | VIM-0 |

TABLE 5

| | | | Comparative Example 1 | Comparative Example 2 | Comparative Example 3 | Comparative Example 4 | Comparative Example 5 | Comparative Example 6 |
|---|---|---|---|---|---|---|---|---|
| Surface layer | Thermoplastic resin | PBT*1) | 100 | 100 | — | — | — | — |
| | | PBN*2) | — | — | 100 | 100 | 100 | 100 |
| | Conductive agent | Carbon black*3) | 12 | 12 | 12 | 12 | 12 | 12 |
| | Flame retardant | TBBA carbonate resin*10) | — | — | — | — | — | 5 |
| | Antimony compound | Antimony trioxide*6) | — | — | — | — | — | — |
| | Mixing temperature(° C.) | | 250 | 250 | 260 | 260 | 260 | 260 |
| Base layer | Thermoplastic resin | PBT*1) | 100 | 100 | 80 | 80 | 60 | 80 |
| | Thermoplastic elastomer | Polyester elastomer(1)*7) | — | — | 20 | — | — | — |
| | | Polyester elastomer(2)*8) | — | — | — | 20 | — | 20 |
| | | Polyester elastomer(3)*11) | — | — | — | — | 40 | — |
| | Conductive agent | Carbon black*3) | 16 | 16 | 14 | 16 | 14 | 16 |
| | Flame retardant | TBBA epoxy resin(1)*4) | — | — | — | — | — | — |
| | | TBBA epoxy resin(2)*5) | — | — | — | — | 15 | — |

TABLE 5-continued

| | | Comparative Example 1 | Comparative Example 2 | Comparative Example 3 | Comparative Example 4 | Comparative Example 5 | Comparative Example 6 |
|---|---|---|---|---|---|---|---|
| | TBBA carbonate resin*10) | — | 10 | 15 | 10 | — | 10 |
| Antimony compound | Antimony trioxide*6) | — | 3 | 5 | 3 | 5 | 3 |
| | Sodium antimonate*9) | — | — | — | — | — | — |
| Mixing temperature(° C.) | | 250 | 250 | 240 | 250 | 240 | 250 |
| Die temperature(° C.) | | 250 | 250 | 260 | 260 | 260 | 260 |
| Modulus of elasticity in tension(MPa) | | 2250 | 2300 | 2000 | 1900 | 1100 | 1800 |
| Surface properties | | Pass | Fail | Fail | Fail | Pass | Fail |
| Flame retardance | | Fail | VIM-2 | VIM-0 | VIM-2 | VIM-0 | VIM-0 |

*10)TBBA carbonate resin: Teijin Chemicals Ltd., Fire Guard (trade name) FG7500

*11)Polyester elastomer (3): Toyobo Co., Ltd., Pelprene (trade name) P-70B (melting point: 200° C.)

Tables 1 to 4 show that the belts according to Examples had a high modulus of elasticity in tension and flame retardance, as well as excellent surface properties. In contrast, Comparative Example 1 without a flame retardant had low flame retardance, and Comparative Examples 2 to 4 containing a TBBA carbonate resin as a flame retardant exhibited poor dispersion and poor surface properties. Comparative Example 5 containing a polyester elastomer having a melting point below 210° C. had a low modulus of elasticity. Comparative Example 6 containing a TBBA carbonate resin as a flame retardant in the surface layer exhibited poor dispersion and poor surface properties.

What is claimed is:

1. An electroconductive endless belt for use as an intermediate transfer member that is disposed between an image-forming unit and a recording medium, is circularly driven by a drive unit, and temporarily holds a toner image transferred from the image-forming unit and subsequently transfers the toner image onto the recording medium, wherein the electroconductive endless belt has a multilayer structure including at least a surface layer disposed on a base layer, and the base layer is mainly composed of a polyester resin and/or a polyester elastomer and contains a conductive agent, a brominated epoxy resin, and a first antimony compound, the polyester elastomer having a melting point of at least 210° C., wherein the surface layer contains a second antimony compound, and wherein the average particle size of the second antimony compound in the surface layer is 2 μm or less.

2. The electroconductive endless belt according to claim 1, wherein the brominated epoxy resin is derived from tetrabromobisphenol A.

3. The electroconductive endless belt according to claim 1, wherein the surface layer is mainly composed of a polyester resin and/or a polyester elastomer, the polyester elastomer having a melting point of at least 210° C.

4. The electroconductive endless belt according to claim 1, wherein a thickness of the base layer is 70 to 99% of a total thickness of the belt.

5. The electroconductive endless belt according to claim 1, wherein the polyester resin and/or the polyester elastomer of the base layer comprises a carbodiimide compound.

6. The electroconductive endless belt according to claim 1, wherein the surface layer contains a brominated epoxy resin.

7. The electroconductive endless belt according to claim 1, wherein the brominated epoxy resin is terminated with tribromophenol.

8. An electroconductive endless belt for use in a tandem transfer and transport system that is circularly driven by a drive unit to transport a recording medium held on the electroconductive endless belt by electrostatic adsorption through a plurality of image-forming units so that toner images formed on the image-forming units are sequentially transferred onto the recording medium, wherein the electroconductive endless belt has a multilayer structure including at least a surface layer disposed on a base layer, and the base layer is mainly composed of a polyester resin and/or a polyester elastomer and contains a conductive agent, a brominated epoxy resin, and a first antimony compound, the polyester elastomer having a melting point of at least 210° C.;

wherein the surface layer contains a second antimony compound; and wherein the average particle size of the second antimony compound in the surface layer is 2 μm or less.

9. The electroconductive endless belt according to claim 8, wherein the brominated epoxy resin is derived from tetrabromobisphenol A.

10. The electroconductive endless belt according to claim 8, wherein the surface layer is mainly composed of a polyester resin and/or a polyester elastomer, the polyester elastomer having a melting point of at least 210° C.

11. The electroconductive endless belt according to claim 8, wherein a thickness of the base layer is 70 to 99% of a total thickness of the belt.

12. The electroconductive endless belt according to claim 8, wherein the polyester resin and/or the polyester elastomer of the base layer comprises a carbodiimide compound.

13. The electroconductive endless belt according to claim 8, wherein the surface layer contains a brominated epoxy resin.

14. The electroconductive endless belt according to claim 8, wherein the brominated epoxy resin is terminated with tribromophenol.

* * * * *